US011004389B2

(12) United States Patent
Chang

(10) Patent No.: US 11,004,389 B2
(45) Date of Patent: May 11, 2021

(54) PANEL CONTROL DEVICE AND OPERATION METHOD THEREOF

(71) Applicant: Novatek Microelectronics Corp., Hsinchu (TW)

(72) Inventor: Hua-Gang Chang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/526,992

(22) Filed: Jul. 30, 2019

(65) Prior Publication Data

US 2021/0035498 A1 Feb. 4, 2021

(51) Int. Cl.
*G09G 3/3233* (2016.01)

(52) U.S. Cl.
CPC ..... *G09G 3/3233* (2013.01); *G09G 2320/046* (2013.01); *G09G 2340/16* (2013.01); *G09G 2360/18* (2013.01)

(58) Field of Classification Search
CPC ..... G09G 2320/046; G09G 2300/026; G09G 2320/0271; G09G 2320/0613; G09G 2320/0626; G06F 3/1446; G06F 3/1423; G06F 3/0416; G06F 3/1454
See application file for complete search history.

(56) References Cited

U.S. PATENT DOCUMENTS

2017/0047044 A1* 2/2017 Zheng ..... G09G 3/32
2018/0052651 A1* 2/2018 Son ..... G06F 3/1446
2019/0129596 A1* 5/2019 Ligameri ..... G06F 1/1647

* cited by examiner

*Primary Examiner* — Gerald Johnson
(74) *Attorney, Agent, or Firm* — JCIPRNET

(57) ABSTRACT

A panel control device and an operation method thereof are provided. The panel control device includes a display port and a control circuit. The display port receives video data from a former stage device. The control circuit performs an anti-burn-in process on the video data according to a processing degree. After the former stage device issues a panel self-refresh entering command to the panel control device, the panel control device enters a panel self-refresh mode, and the control circuit increases the processing degree according to the panel self-refresh entering command, so as to perform the anti-burn-in process on the video data according to the increased processing degree.

44 Claims, 6 Drawing Sheets

PANEL CONTROL DEVICE AND OPERATION METHOD THEREOF

BACKGROUND

Field of the Invention

The invention relates to a display device and more particularly, to a panel control device and an operation method thereof.

Description of Related Art

Some types of display panels have a phenomenon of image sticking. For example, in an organic light emitting diode (OLED) display panel, the phenomenon of image sticking may occur to the OLED display panel after displaying a static object for a time period, and this phenomenon is a so-called burn-in (or referred to as burn-down) phenomenon. The OLED display panel has an organic compound film. As the OLED display panel is used for a longer duration and generates heat, the organic material thereof is gradually aged. The image sticking of the OLED display panel actually refers to a same still image displayed by some pixels at a certain fixed position on a screen for a long time, which causes the organic compound film corresponding to the pixels to be aged in a faster speed than pixels in other positions. These rapidly aged pixels leave the image sticking on the screen. Generally, the burn-in phenomenon is irreversible. How to prevent the occurrence of the burn-in phenomenon is an important subject to the technical field related to display devices.

A panel control device receives video data from a former stage device and then, drives a display panel according to the video data. Generally, the panel control device has to perform image analysis on several (or dozens) frames in the video data, so as to judge whether a current frame is a still image. When a judgment result indicates that the current frame is a still image, the panel control device performs an anti-burn-in process on the video data, thereby preventing the burn-in phenomenon from occurring to the display panel. In order to judge whether the current frame is the still image, the panel control device spends a considerably lone time for performing the image analysis.

It should be noted that the contents of the section of "Description of Related Art" is used for facilitating the understanding of the invention. A part of the contents (or all of the contents) disclosed in the section of "Description of Related Art" may not pertain to the conventional technology known to the persons with ordinary skilled in the art. The contents disclosed in the section of "Description of Related Art" do not represent that the contents have been known to the persons with ordinary skilled in the art prior to the filing of this invention application.

SUMMARY

The invention provides a panel control device and an operation method thereof to dynamically adjust a processing degree of an anti-burn-in process according to a panel self-refresh command issued by a former stage device.

According to an embodiment of the invention, a panel control device configured to drive a display panel is provided. The panel control device includes a first display port and a control circuit. The first display port is configured to receive video data from a second display port of a former stage device. The control circuit is coupled to the first display port. The control circuit is configured to perform an anti-burn-in process on the video data according to a processing degree. After the former stage device issues a panel self-refresh entering command to the panel control device, the panel control device enters a panel self-refresh mode, and the control circuit increases the processing degree according to the panel self-refresh entering command, so as to perform the anti-burn-in process on the video data according to the increased processing degree.

According to an embodiment of the invention, an operation method of a panel control device is provided. The operation method includes: receiving video data from a second display port of a former stage device by a first display port of the panel control device, wherein the panel control device is configured to drive a display panel; performing an anti-burn-in process on the video data according to a processing degree by a control circuit of the panel control device; and after the former stage device issues a panel self-refresh entering command to the panel control device, entering a panel self-refresh mode by the panel control device, and increasing the processing degree according to the panel self-refresh entering command by the control circuit, so as to perform the anti-burn-in process on the video data according to the increased processing degree.

According to an embodiment of the invention, a panel control device configured to drive a display panel is provided. The panel control device includes a first display port and a control circuit. The first display port is configured to receive video data from a second display port of a former stage device. The control circuit is coupled to the first display port. The control circuit is configured to perform an anti-burn-in process on the video data according to a processing degree. After the former stage device issues a panel self-refresh exiting command to the panel control device, the panel control device exits a panel self-refresh mode, and the control circuit reduces the processing degree according to the panel self-refresh exiting command, so as to perform the anti-burn-in process on the video data according to the reduced processing degree.

According to an embodiment of the invention, an operation method of a panel control device is provided. The operation method includes: receiving video data from a second display port of a former stage device by a first display port of the panel control device, wherein the panel control device is configured to drive a display panel; performing an anti-burn-in process on the video data according to a processing degree by a control circuit of the panel control device; and after the former stage device issues a panel self-refresh exiting command to the panel control device, exiting a panel self-refresh mode by the panel control device, and reducing the processing degree according to the panel self-refresh exiting command by the control circuit, so as to perform the anti-burn-in process on the video data according to the reduced processing degree.

Based on the above, the panel control device and the operation method provided by the embodiments of the invention can receive the video data and the panel self-refresh command (e.g., the panel self-refresh entering command and/or the panel self-refresh exiting command) from the former stage device. For example, after the former stage device issues the panel self-refresh entering command to the panel control device, the control circuit can increase the processing degree of the anti-burn-in process according to the panel self-refresh entering command. Moreover, in another example, after the former stage device issues the panel self-refresh exiting command to the panel control device, the control circuit can reduce the processing degree of the anti-burn-in process according to the panel self-refresh exiting command. Thus, the control circuit can dynamically adjust the processing degree of the anti-burn-in process according to the panel self-refresh command issued by the former stage device.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
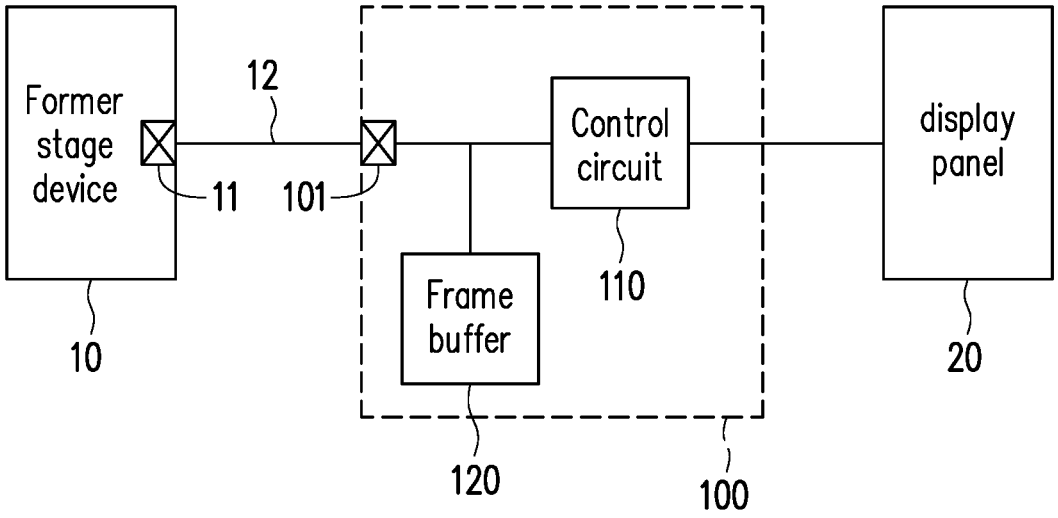
FIG. 1 is a schematic circuit block diagram illustrating a display device according to an embodiment of the invention.

The term "couple (or connect)" throughout the specification (including the claims) of this application are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. In addition, terms such as "first" and "second" mentioned throughout the specification (including the claims) of this application are only for naming the names of the elements or distinguishing different embodiments or scopes and are not intended to limit the upper limit or the lower limit of the number of the elements not intended to limit sequences of the elements. Moreover, elements/components/steps with same reference numerals represent same or similar parts in the drawings and embodiments. Elements/components/notations with the same reference numerals in different embodiments may be referenced to the related description.

Some types of display panels may have a phenomenon of image sticking. For example, in an organic light emitting diode (OLED) display panel, the phenomenon of image sticking may occur to the OLED display panel after displaying a static object for a long time period, and this phenomenon is a so-called burn-in (or referred to as burn-down) phenomenon. How to prevent the occurrence of the burn-in phenomenon is an important subject to the technical field related to display devices.

In some embodiments, for a pixel which the burn-in phenomenon likely occurs to, the probability of the occurrence of the burn-in phenomenon may be effectively reduced by adaptively reducing a brightness of the pixel. The lower the brightness is, the less heat the pixel generates. Thereby, the probability of the occurrence of the burn-in phenomenon may be reduced. In anyway, the reduction of the pixel brightness means the reduction of image brightness. For a still image scene, a reduction extent (i.e., a processing degree) of the pixel brightness may be increased. For a motion video, the reduction extent (i.e., the processing degree) of the pixel brightness may be decreased, or even the pixel brightness may be recovered to a normal brightness (i.e., the brightness is not reduced).

FIG. 1 is a schematic circuit block diagram illustrating a display device according to an embodiment of the invention. The display device illustrated in FIG. 1 includes a former stage device 10, a panel control device 100 and a display panel 20. Based on a design requirement, the former stage device 10 may include a graphics processing unit (GPU) and/or other circuits. The former stage device 10 may process an image and then, output video data 12 to the panel control device 100. The panel control device 100 may include (or may be implemented as) a timing controller for controlling the display panel and/or other circuits. The former stage device 10 may judge whether the video data 12 indicates at least one static image within a whole frame and generate a panel self-refresh (PSR) entering command according to the judgment result. When a current frame has a still image (a part or whole of the frame), the former stage device 10 may issue the PSR entering command to the panel control device 100. After the former stage device 10 issues the PSR entering command to the panel control device 100, the panel control device 100 enters a panel self-refresh (PSR) mode. After the former stage device 10 issues a panel self-refresh (PSR) exiting command to the panel control device 100, the panel control device exits the PSR mode.

Consequently, in the PSR mode, the panel control device 100 can be configured to increase the processing degree according to the panel self-refresh entering command, so as to perform the anti-burn-in process on the video data according to the increased processing degree. In other words, the former stage device 10 can be utilized to take or share the responsibility of judging whether a current frame has a still image (a part or whole of the frame), thus increasing the efficiency of burn-in prevention.

For example, the panel control device 100 further includes a control circuit 110 and a frame buffer 120. The control circuit 110 is coupled to a display port 101 to receive the video data 12. The control circuit 110 may perform an anti-burn-in process on the video data 12 according to a processing degree and then drive the display panel 20 according to the video data processed by the anti-burn-in process to display the image. In the PSR mode, the panel control device 100 can be configured to increase the processing degree according to the panel self-refresh entering command, so as to perform the anti-burn-in process on the video data according to the increased processing degree. In addition, the frame buffer 120 may store the video data 12 in the PSR mode. In the PSR mode, data transmission between a display port 11 and the display port 101 may be turned off, and the control circuit 110 may generate a plurality of frames according to the video data stored by the frame buffer 120 in the PSR mode. The PSR mode is a conventional technique and thus, will not be repeatedly described. It is also noted that other kinds of commands and/or modes can be also implemented in other embodiments.

Figure 2:
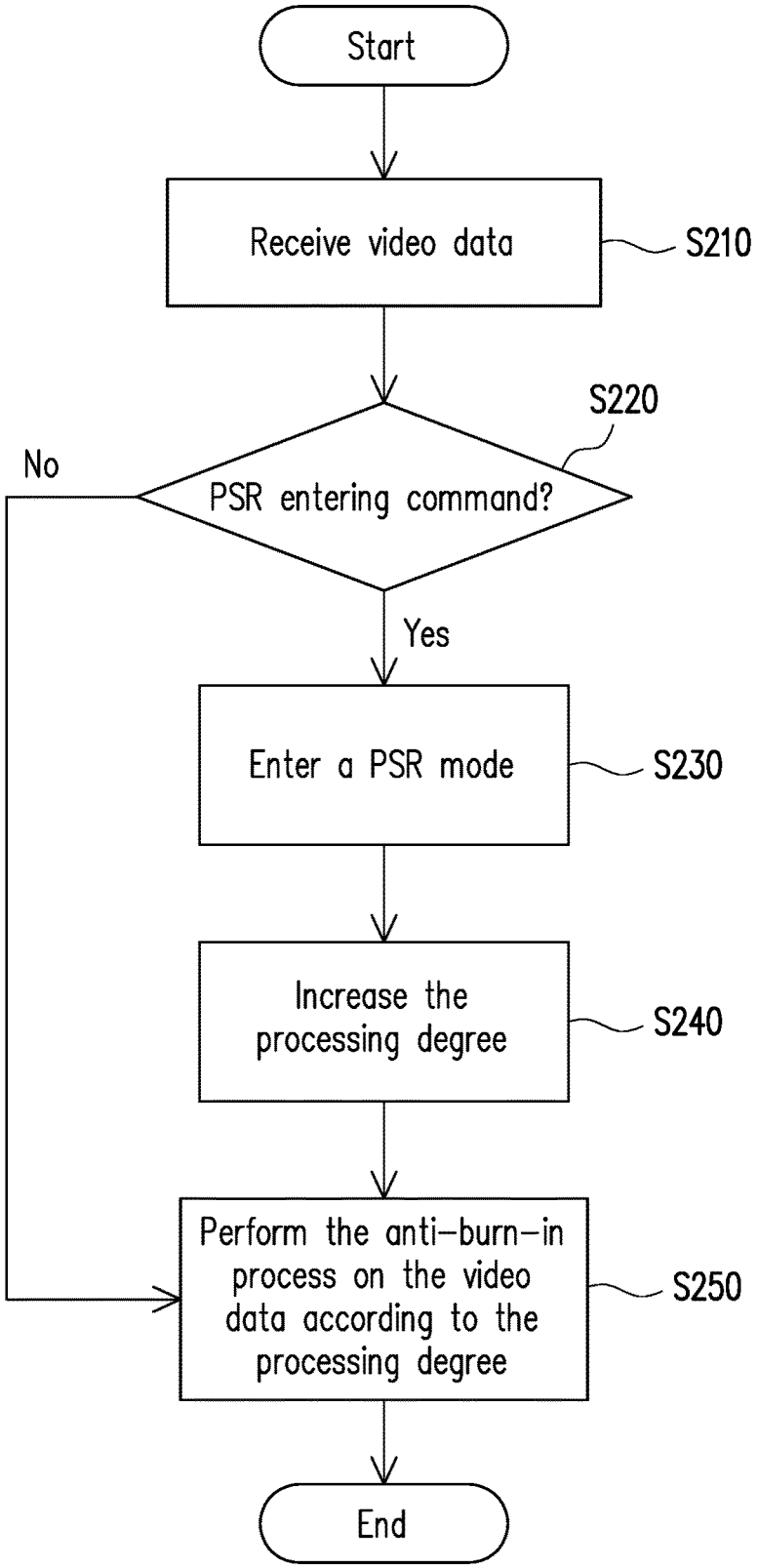
FIG. 2 is a flowchart illustrating an operation method of a display device according to an embodiment of the invention.

FIG. 2 is a flowchart illustrating an operation method of a display device according to an embodiment of the invention. Referring to FIG. 1 and FIG. 2, in step S210, the display port 101 of the panel control device 100 may receive the video data 12 from the display port 11 of the former stage device 10. According to the video data 12 provided by the former stage device 10, the panel control device 100 may drive the display panel 20 to display an image. Based on a design requirement, the display panel 20 may be an OLED display panel or other types of display panels.

Based on a design requirement, the data transmission between the display port 11 and the display port 101 may use any data transmission protocol. For example, the protocol used by the data transmission between the display port 11 and the display port 101 may include an embedded display port (eDP) transmission protocol. Namely, the display port 11 is an eDP port (e.g., an eDPTX port), and the display port 101 is another eDP port (e.g., an eDPRX port). The eDP transmission protocol is a conventional technique and thus, will not be repeatedly described.

In step S220, whether the former stage device 10 issues the PSR entering command to the panel control device 100 may be determined. In a condition that the former stage device 10 does not issue the PSR entering command to the panel control device 100 (i.e., the determination result of step S220 is "No"), the control circuit 110 may perform the anti-burn-in process on the video data 12 according to a processing degree corresponding to a motion image (step S250). For example, in the condition that the former stage device 10 does not issue the PSR entering command to the panel control device 100, a reduction extent of a pixel brightness (i.e., a processing degree of the anti-burn-in process) may be zero, i.e., the pixel brightness of the video data 12 is reduced.

After the former stage device 10 issues the PSR entering command to the panel control device 100 (i.e., the determination result of step S220 is "Yes"), the panel control device 100 may enter the PSR mode (step S230), and the control circuit 110 may increase the processing degree of the anti-burn-in process according to the PSR entering command (step S240), so as to perform the anti-burn-in process on the video data 12 according to the increased processing degree (step S250).

For example, after the former stage device 10 issues the PSR entering command to the panel control device 100, the control circuit 110 may increase the reduction extent of the pixel brightness (i.e., the processing degree of the anti-burn-in process) according to the PSR entering command. The control circuit 110 may reduce the pixel brightness of the video data 12 (i.e., perform the anti-burn-in process on the video data 12) according to the new reduction extent (i.e., the increased processing degree). Thus, the control circuit 100 may perform the anti-burn-in process on the video data 12 immediately and adaptively without spending more time, thereby preventing the burn-in phenomenon from occurring to the display panel 20. It is noted that numerous approaches capable of preventing burn-in phenomenon can be adopted by the control circuit 110.

Figure 3:
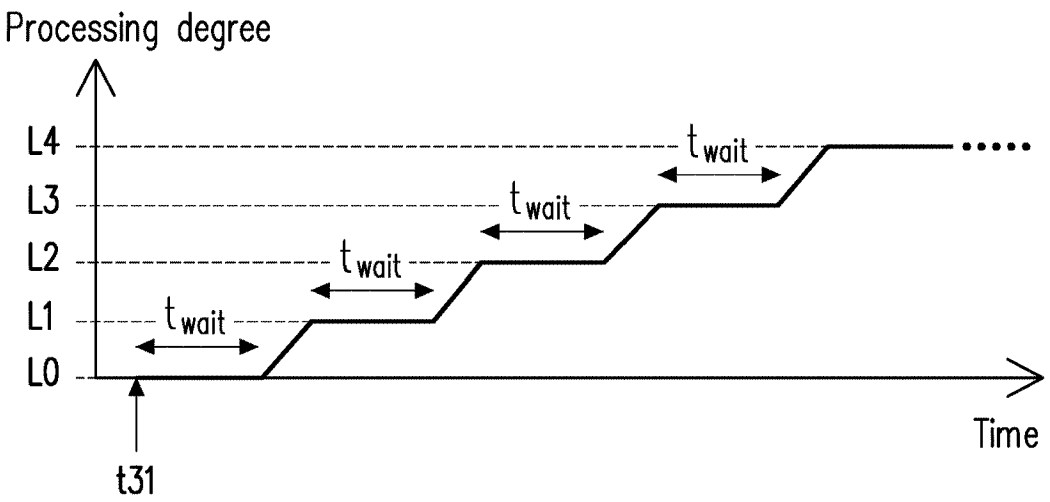
FIG. 3 is a schematic curve diagram illustrating the control circuit, in a condition of performing the image analysis on the video data, adjusting the processing degree of the anti-burn-in process.

FIG. 3 is a schematic curve diagram illustrating the control circuit 110, in a condition of performing the image analysis on the video data 12, adjusting the processing degree of the anti-burn-in process. In FIG. 3, the horizontal axis represents the time, and the vertical axis represents the processing degree of the anti-burn-in process. In the embodiment illustrated in FIG. 3, the panel control device 110 may perform the image analysis on several (or dozens) of frames in the video data 12, so as to judge whether a current frame has a still image. It is assumed in this case that starting from a time t31, each image frame in the video data 12 has the still image. The control circuit 110 spends a time period to perform the image analysis, so as to judge whether a current frame has the still image. Once it is determined that the current frame has the still image, the control circuit 110 increases the processing degree of the anti-burn-in process from L0 to L1 and then, performs the anti-burn-in process on the video data 12 according to the processing degree L1. Thereafter, after the control circuit 110 spends another time period $t_{wait}$ to perform the image analysis, the control circuit 110 may confirm that the current frame still has the still image. Thus, the control circuit 110 increases the processing degree of the anti-burn-in process from L1 to L2 and then, performs the anti-burn-in process on the video data 12 according to the processing degree L2. By deducing in the same way, the control circuit 110 increases the processing degree of the anti-burn-in process from L2 to L3, and from L3 to L4. It may be known according to FIG. 3, the control circuit 110 spends a considerably lone time (including 4 time periods $t_{wait}$) for performing the image analysis.

Figure 4:
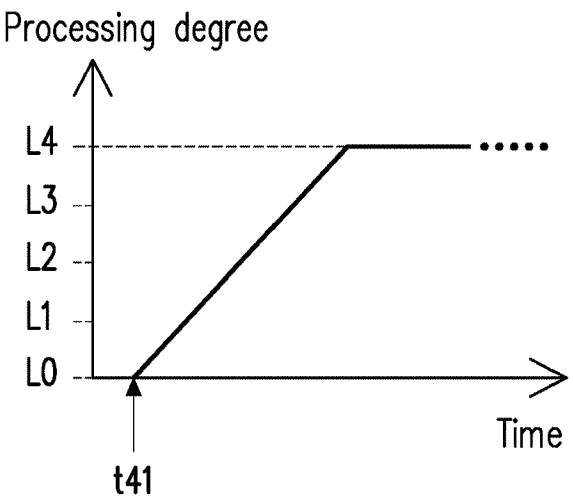
FIG. 4 is a schematic curve diagram illustrating the control circuit, in a condition of not performing the image analysis on the video data, adjusting the processing degree of the anti-burn-in process.

FIG. 4 is a schematic curve diagram illustrating the control circuit 110, in a condition of not performing the image analysis on the video data 12, adjusting the processing degree of the anti-burn-in process. In FIG. 4, the horizontal axis represents the time, and the vertical axis represents the processing degree of the anti-burn-in process. In the embodiment illustrated in FIG. 4, the control circuit 110 may acquire that the current frame has the still image according to the PSR entering command issued by the former stage device 10. It is assumed in this case that starting from a time t41, each image frame in the video data 12 has a still image, i.e., the former stage device 10 issues the PSR entering command to the panel control device 100 at the time t41, such that the panel control device 100 enters the PSR mode.

After the former stage device 10 issues the PSR entering command to the panel control device, the control circuit 110 can instantly increase the processing degree of the anti-burn-in process to a predetermined level instead of gradually increasing the level of the processing degree. The predetermined level may be defined based on a design requirement. For example, the predetermined level may be a maximum level. Taking the embodiment as illustrated in FIG. 4 for example, once the control circuit 110 receives the PSR entering command, the control circuit 110 increases the processing degree of the anti-burn-in process from L0 to L4. In comparison with the embodiment illustrated in FIG. 3, the time (including the 4 time periods ti) for performing the image analysis is saved in the embodiment illustrated in FIG. 4.

In other embodiments, the anti-burn-in process should not be limited to the description set forth above. For example, in some embodiments, the anti-burn-in process includes a brightness control operation, and the processing degree includes a brightness control degree. Referring to FIG. 1, after the former stage device 10 issues the PSR entering command to the panel control device 100, the control circuit 110 may adjust the brightness control degree of the brightness control operation to a maximum level at a certain increasing speed. The control circuit 110 may perform the brightness control operation on the video data 12 according to the brightness control degree to dim the video data 12.

In some other embodiments, the anti-burn-in operation includes a smooth filter operation, and the processing degree includes an edge smoothing degree. After the former stage device 10 issues the PSR entering command to the panel control device 100, the control circuit 110 may adjust the edge smoothing degree of the smooth filter operation to a maximum level at a certain increasing speed. The control circuit 100 may perform the smooth filter operation on the video data 12 according to the edge smoothing degree.

In yet other embodiments, the anti-burn-in process includes a dynamic chromatic control operation, and the processing degree includes a dynamic chromatic control degree. After the former stage device 10 issues the PSR entering command to the panel control device 100, the control circuit 110 may adjust the dynamic chromatic control degree of the dynamic chromatic control operation to a maximum level at a certain increasing speed. The control circuit 110 may perform the dynamic chromatic control operation on the video data 12 according to the dynamic chromatic control degree to dim a blue brightness of the video data 12.

In some other embodiments, the anti-burn-in process includes an image orbit operation, and the processing degree includes a moving distance. After the former stage device 10 issues the PSR entering command to the panel control device 100, the control circuit 110 may adjust the moving distance of the image orbit operation to a maximum level at a certain increasing speed. The control circuit 110 may perform the image orbit operation on the video data 12 according to the moving distance to move the image of the video data 12.

Referring to FIG. 1, in some other embodiments, the former stage device 10 may judge whether the video data 12 includes at least one static image region within the whole frame and generate the PSR entering command according to the judgment result. For example, the former stage device 10 may divide the current frame of the video data 12 into at least one partial update region and at least one static image region, and the PSR entering command may further indicate at least one partial update region different from the at least one static image region.

Figure 5:
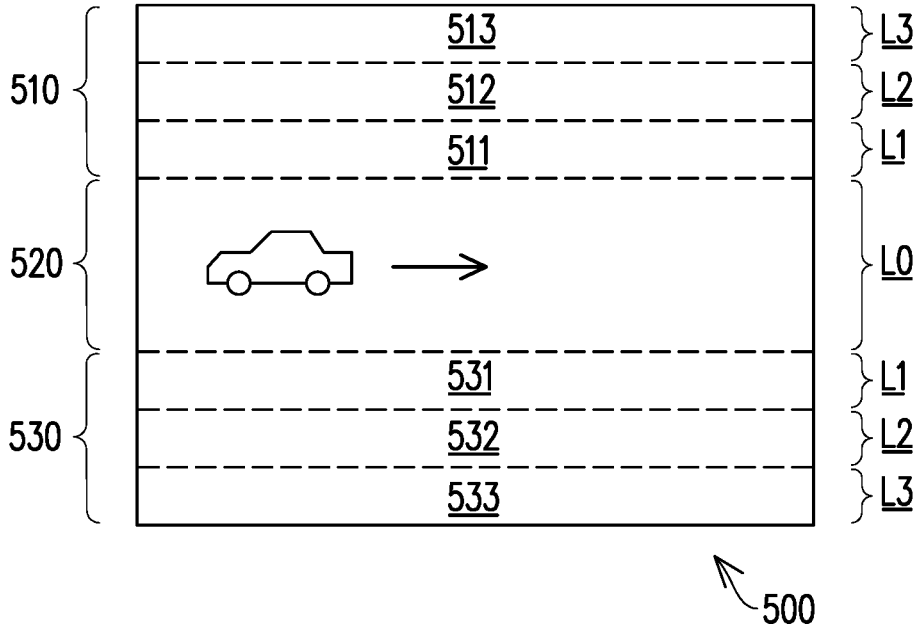
FIG. 5 is a schematic diagram illustrating a current frame divided into a partial update region and two static image regions.

FIG. 5 is a schematic diagram illustrating a current frame 500 divided into a partial update region and two static image regions. It is assumed in this case that in the current frame 500 illustrated in FIG. 5, a vehicle is driving on a stationary background. The former stage device 10 defines a moving range of this vehicle as a partial update region 520 and defines the stationary background as at least one static image region such as static image regions 510 and 530. The former stage device 10 outputs a PSR entering command, so as to indicate the partial update region 520 different from the static image regions 510 and 530. In addition, the panel control device 100 may process the static image regions 510 and 530 by using the PSR mode. The former stage device 10 only has to provide pixel data of the partial update region 520 to the panel control device 100, such that a transmission frequency band width used by the pixel data of the static image regions 510 and 530 may be saved. Details related to "dividing the current frame 500 into the partial update region 520 and the static image regions 510 and 530" are not limited in the present embodiment. For example, the former stage device 10 may provide the pixel data of the partial update region 520 to the panel control device 100 by adopting a conventional panel self-refresh 2 (PSR2) mode.

The control circuit 110 may reduce a processing degree corresponding to the partial update region 520 in the PSR mode, for example, by reducing the processing degree of the anti-burn-in process performed on the partial update region 520 to L0. The processing degree L0 may be determined according to a design requirement. For example, in the PSR mode, the control circuit 110 may set the processing degree L0 corresponding to the partial update region 520 to be zero.

The control circuit 110 may increase the processing degree of the anti-burn-in process performed on the static image regions 510 and 530. The static image region 510 (and/or the static image region 530) may be divided into one or more sub static regions according to a design requirement. The control circuit 110 may set processing degrees corresponding to different sub static regions to be different values. Taking the embodiment as illustrated in FIG. 5 for example, the static image region 510 is divided into sub static regions 511, 512 and 513. A processing degree corresponding to a farer sub static region among the static regions 511-513 which is farer away from the partial update region 520 is greater than a processing degree corresponding to a nearer sub static region among the sub static regions 511-513 which is nearer to the partial update region 520. For example, the processing degree L2 corresponding to the sub static region 512 (which is the farer sub static region) is greater than the processing degree L1 corresponding to the sub static region 511 (which is the nearer sub static region), wherein the processing degree L1 is greater than the the processing degree L0. The processing degree L3 corresponding to the sub static region 513 (which is the farer sub static region) is greater than the processing degree L2 corresponding to the sub static region 512 (which is the nearer sub static region). By deducing in the same way, the static image region 530 is divided into sub static regions 531, 532 and 533, wherein the processing degree L2 corresponding to the sub static region 532 is greater than the processing degree L1 corresponding to the sub static region 531, and the processing degree L3 corresponding to the sub static region 533 is greater than the processing degree L2 corresponding to the sub static region 532.

Figure 6:
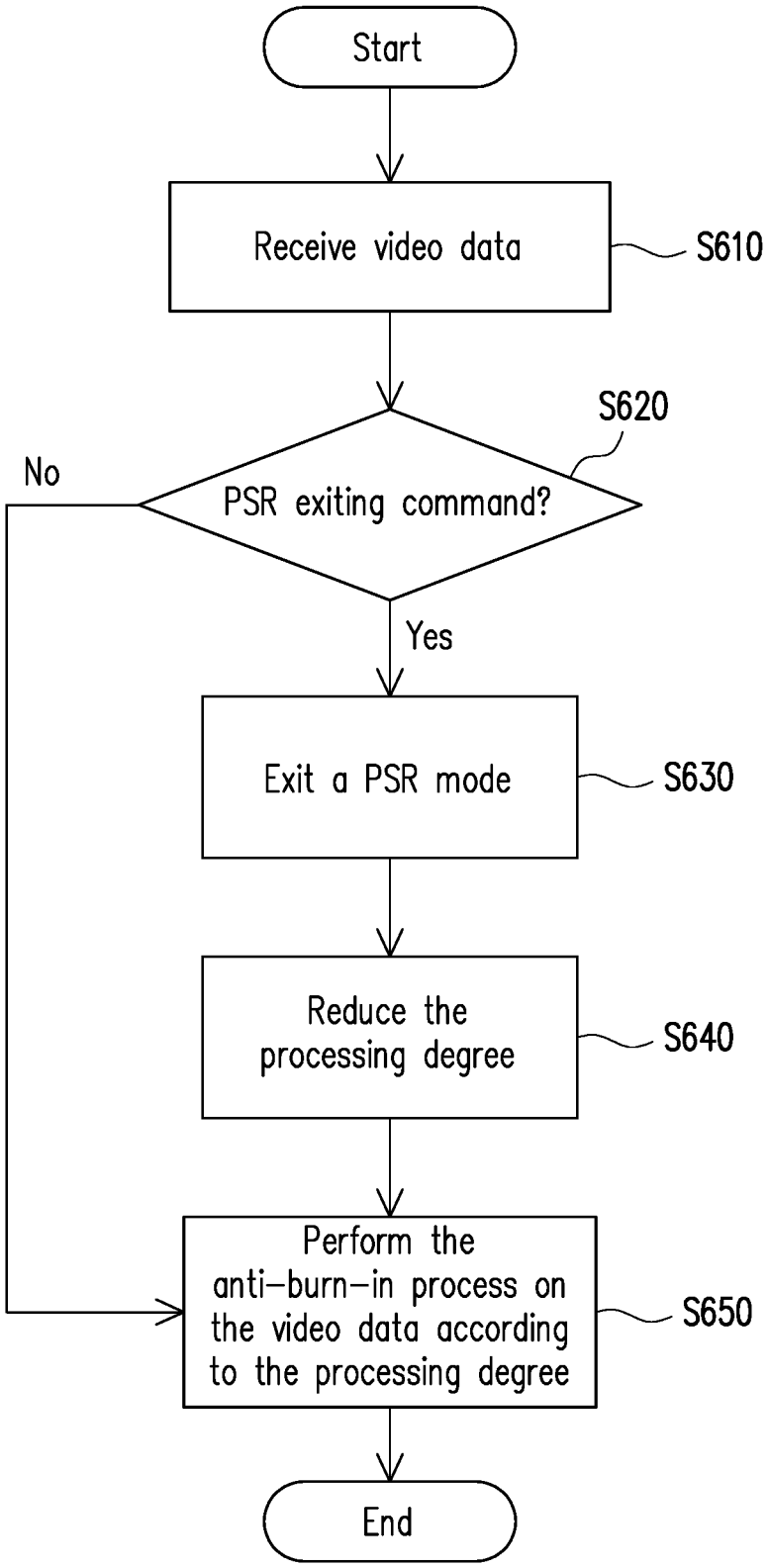
FIG. 6 is a flowchart illustrating an operation method of a display device according to another embodiment of the invention.

FIG. 6 is a flowchart illustrating an operation method of a display device according to another embodiment of the invention. Steps S610 and S650 illustrated in FIG. 6 may be inferred with reference to the descriptions related to steps S210 and S250 illustrated in FIG. 2 and thus, will not be repeated. Referring to FIG. 1 and FIG. 6, the former stage device 10 may also issue a PSR exiting command to the panel control device 100. Whether the former stage device 10 issues the PSR exiting command to the panel control device 100 may be determined in step S620. In a condition that the former stage device 10 does not issue the PSR entering command to the panel control device 100 (i.e., the determination result of step S620 is "No"), namely, the panel control device 100 is still operated in the PSR mode, the control circuit 110 may perform the anti-burn-in process on the video data 12 according to a processing degree corresponding to a still image (step S650). For example, in the condition that the former stage device 10 does not issue the PSR entering command to the panel control device 100, the reduction extent of the pixel brightness (i.e., the processing degree of the anti-burn-in process) may be the maximum level.

After the former stage device 10 issues the PSR exiting command to the panel control device 100 (i.e., the determination result of step S620 is "Yes"), the panel control device 100 may exit the PSR mode (step S630), and the control circuit 110 may reduce the processing degree of the anti-burn-in process according to the PSR exiting command (step S640), so as to perform the anti-burn-in process on the video data 12 according to the reduced processing degree (step S650).

For example, after the former stage device 10 issues the PSR entering command to the panel control device 100, the control circuit 110 may increase the reduction extent of the pixel brightness (i.e., the processing degree of the anti-burn-in process) according to the PSR entering command. The control circuit 110 may reduce the pixel brightness of (i.e., perform the anti-burn-in process on) the video data 12 according to a new reduction extent (i.e., an increased processing degree). After the former stage device 10 issues the PSR exiting command to the panel control device 100, the control circuit 110 may decrease the reduction extent (i.e., the processing degree) of the pixel brightness according to the PSR exiting command. The control circuit 110 may perform the anti-burn-in process on the video data 12 according to the new reduction extent (i.e., the reduced processing degree). For example, after the former stage device 10 issues the PSR exiting command to the panel control device 100, the control circuit 110 may decrease the reduction extent to zero (i.e., does not reduce the pixel brightness), so as to recover the pixel brightness to the normal brightness.

The control circuit 110 may reduce the processing degree of the anti-burn-in process by any method. In some embodiments, the control circuit 110 may dynamically (or statically) determine a reducing speed for the processing degree. For example, after the former stage device 10 issues the PSR exiting command to the panel control device 100, the control circuit 10 may calculate an image change degree of the current frame of the video data 12 according to a previous frame, and the control circuit 110 may determine the reducing speed of reducing the processing degree according to the image change degree.

In some other embodiments, the control circuit 110 may determine the reducing speed of reducing the processing degree by comparing the image change degree with a threshold. The threshold value may be determined based on a design requirement. When the image change degree is greater than the threshold, the control circuit 110 may rapidly reduce the processing degree of the anti-burn-in process at a first reducing speed. The first reducing speed may be determined based on a design requirement.

Figure 7:
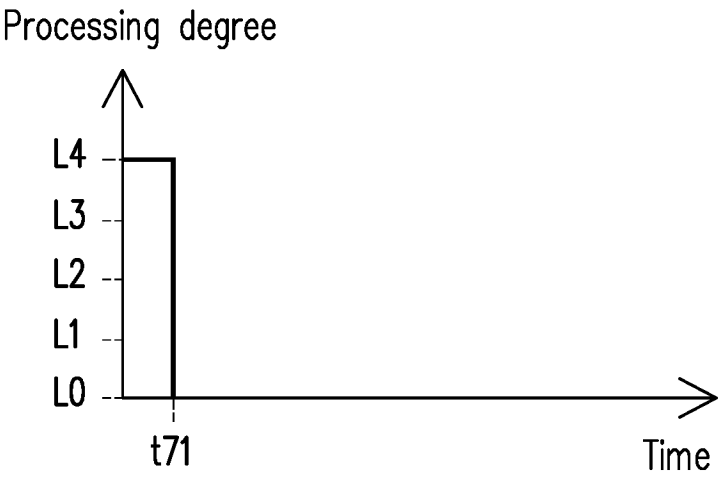
FIG. 7 is a schematic curve diagram illustrating the adjustment of the processing degree of the anti-burn-in process in a condition that the image change degree is greater than the threshold.

FIG. 7 is a schematic curve diagram illustrating the adjustment of the processing degree of the anti-burn-in process in a condition that the image change degree is greater than the threshold. In FIG. 7, the horizontal axis represents the time, and the vertical axis represents the processing degree of the anti-burn-in process. It is assumed in this case that starting from a time t71, each image frame in the video data 12 does not have the still image, i.e., the former stage device 10 issues the PSR exiting command to the panel control device 100 at the time t71, such that the panel control device 100 exits the PSR mode. In the embodiment illustrated in FIG. 7, the control circuit 110 may rapidly reduce the processing degree of the anti-burn-in process at the first reducing speed.

Referring to FIG. 1, when the image change degree is less than the threshold, the control circuit 110 may gradually reduce the processing degree at a second reducing speed slower than the first reducing speed. The second reducing speed may be determined based on a design requirement.

Figure 8:
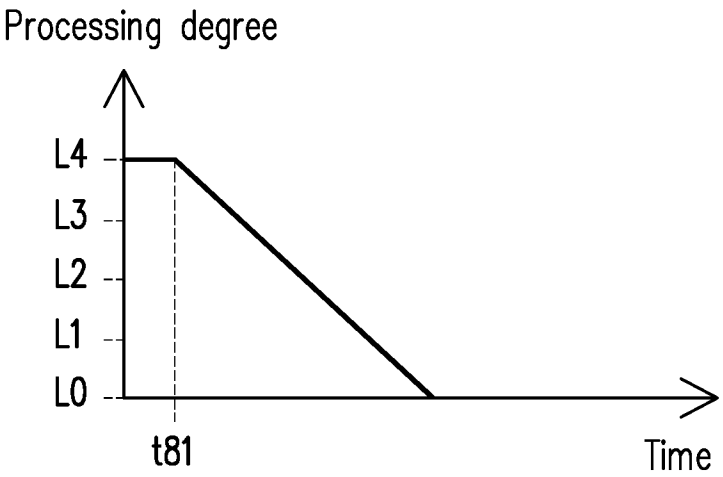
FIG. 8 is a schematic curve diagram illustrating the adjustment of the processing degree of the anti-burn-in process in a condition that the image change degree is less than the threshold.

FIG. 8 is a schematic curve diagram illustrating the adjustment of the processing degree of the anti-burn-in process in a condition that the image change degree is less than the threshold. In FIG. 8, the horizontal axis represents the time, and the vertical axis represents the processing degree of the anti-burn-in process. It is assumed in this case that starting from a time t81, each image frame in the video data 12 does not have the still image, i.e., the former stage device 10 issues the PSR exiting command to the panel control device 100 at the time t81, such that the panel control device 100 exits the PSR mode. In the embodiment illustrated in FIG. 8, the control circuit 110 may gradually reduce the processing degree at a second reducing speed slower than the first reducing speed.

Table 1 below illustrates the process of adjusting the processing degree of the anti-burn-in process at different positions in the display panel 20 according to the embodiments of the invention. The horizontal axis in Table 1 represent the time, wherein T1-T9 represent different time points. The vertical axis in Table 1 represents the positions in the display panel 20, wherein PL1-PL7 represent different positions in the display panel 20.

TABLE 1 at different positions, the process of reducing the processing degree of the anti-burn-in process.

| | Time | | | | | | | | |
|---|---|---|---|---|---|---|---|---|---|
| Position | T1 | T2 | T3 | T4 | T5 | T6 | T7 | T8 | T9 |
| PL1 | L0 | L1 | L2 | L3 | L3 | L3 | L2 | L1 | L0 |
| PL2 | L0 | L1 | L2 | L3 | L3 | L3 | L2 | L1 | L0 |
| PL3 | L0 | L1 | L2 | L3 | L3 | L3 | L2 | L1 | L0 |
| PL4 | L0 | L1 | L2 | L3 | L2 | L3 | L2 | L1 | L0 |
| PL5 | L0 | L1 | L2 | L2 | L1 | L2 | L1 | L0 | L0 |
| PL6 | L0 | L1 | L2 | L1 | L0 | L1 | L0 | L0 | L0 |
| PL7 | L0 | L1 | L2 | L2 | L1 | L2 | L1 | L0 | L0 |

Referring to FIG. 1 and Table 1, at the time point T1, the panel control device 100 is operated in a normal operation mode. Thus, it is assumed that the processing degrees of the anti-burn-in process performed at the positions PL1-PL7 are all set to L0. After the time point T1, the former stage device 10 issues the PSR entering command to the panel control device 100, such that the panel control device 100 enters the PSR mode. At the time point T2, based on the PSR entering command, the control circuit 110 increases the processing degrees of the anti-burn-in process performed at the positions PL1-PL7 from L0 to L1. Then, at the time point T3, the control circuit 110 increases the processing degrees of the anti-burn-in process performed at the positions PL1-PL7 from L1 to L2.

After the time point T3, the former stage device 10 issues a panel self-refresh 2 (PSR2) entering command to the panel control device 100, such that the panel control device 100 enters a PSR2 mode. It is assumed that the position PL6 belongs to a partial update region (which may be inferred with reference to the description related to the partial update region 520 illustrated in FIG. 5), and the positions PL1-PL5 and the position PL7 belong to static image regions (which may be inferred with reference to the description related to the static image regions 510 and 530 illustrated in FIG. 5). At the time point T4, the control circuit 110 may reduce the processing degree of the anti-burn-in process performed at the position PL6 (i.e., the partial update region) from L2 to L1. A processing degree corresponding to the position of one among the static regions which is farer away from the partial update region is greater than the processing degree corresponding to a position of one among the sub static regions which is nearer to the partial update region. Thus, for the positions PL5 and PL7 which are nearer the position PL6, the processing degrees of the anti-burn-in process thereof are maintained at L2, and for the positions PL1-PL4 which are farer away from the position PL6, the processing degrees of the anti-burn-in process thereof are increased to L3.

At the time point T5, the control circuit 110 may reduce the processing degree of the anti-burn-in process performed at the position PL6 (the partial update region) from L1 to L0. For the positions PL5 and PL7 which are nearer the position PL6, the processing degrees of the anti-burn-in process thereof are reduced from L2 to L1. According to a distance from the partial update region, the processing degree at the position PL4 is reduced from L3 to L2, and the processing degrees at the positions PL1-PL3 are maintained at L3 (it is assumed herein that L3 is the maximum level).

After the time point T5, the former stage device 10 issues a panel self-refresh 2 (PSR2) exiting command to the panel control device 100, such that the panel control device 100 exits the PSR2 mode (but is till in the PSR mode). At the time point T6, based on the PSR entering command, the control circuit 110 may increase the processing degrees at the positions PL1-PL7. For example, the control circuit 110 may increase the processing degree at the position PL6 from L0 to L1, increase the processing degrees at the positions PL5 and PL7 from L1 to L2, and increase the processing degree at the position PL4 from L2 to L3. Because the processing degrees at the positions PL1-PL3 have reached the maximum level, the processing degrees at the positions PL1-PL3 are maintained at L3.

After the time point T6, the former stage device 10 issues a PSR exiting command to the panel control device 100, such that the panel control device 100 exits the PSR mode. At the time point T7, the control circuit 110 may reduce the processing degrees at the positions PL1-PL7 according to the PSR exiting command. For example, the control circuit 110 may reduce the processing degrees at the positions PL1-PL4 from L3 to L2, reduce the processing degrees at the positions PL5 and PL7 from L2 to L1, and reduce the processing degree at the position PL6 from L1 to L0. By deducing in the same way, at the time point T9, the control circuit 110 may reduce the processing degrees at the positions PL1-PL7 to L0.

Based on different design demands, the blocks of the the panel control device and/or the control circuit 110 may be implemented in a form of hardware, firmware, or in a combination of both of the aforementioned forms.

In terms of the hardware form, the blocks of the panel control device 100 and/or the control circuit 110 may be implemented as logic circuits on an integrated circuit. Related functions of the panel control device 100 and/or the control circuit 110 may be implemented in a form of hardware by utilizing hardware description languages (e.g., Verilog HDL or VHDL) or other suitable programming languages. For example, the panel control device 100 and/or the control circuit 110 may be implemented in one or more controllers, micro-controllers, microprocessors, application-specific integrated circuits (ASICs), digital signal processors (DSPs), field programmable gate arrays (FPGAs) and/or various logic blocks, modules and circuits in other processing units.

In terms of the firmware form, the panel control device 100 and/or the control circuit 110 may be implemented as programming codes. For example, the panel control device 100 and/or the control circuit 110 may be implemented by using general programming languages (e.g., C or C++) or other suitable programming languages. The programming codes may be recorded/stored in recording media, and the aforementioned recording media include, for example, a read only memory (ROM), a storage device and/or a random access memory (RAM). Additionally, the programming codes may be accessed from the recording medium and executed by a computer, a central processing unit (CPU), a controller, a micro-controller or a microprocessor to accomplish the related functions. As for the recording medium, a non-transitory computer readable medium, such as a tape, a disk, a card, a semiconductor memory or a programming logic circuit, may be used. In addition, the programs may be provided to the computer (or the CPU) through any transmission medium (e.g., a communication network or radio waves). The communication network is, for example, the Internet, wired communication, wireless communication or other communication media.

Based on the above, the panel control device and the operation method provided by the embodiments of the invention can receive the video data and the PSR command from the former stage device (e.g., the PSR entering command and/or the PSR exiting command) from the former stage device. After the former stage device issues the PSR entering command to the panel control device, the control circuit can increase the processing degree of the anti-burn-in process according to the PSR entering command. After the former stage device issues the PSR exiting command to the panel control device, the control circuit can reduce the processing degree of the anti-burn-in process according to the PSR exiting command. Thus, the control circuit can dynamically adjust the processing degree of the anti-burn-in process according to the panel self-refresh command issued by the former stage device.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A panel control device, configured to drive a display panel, comprising:

a first display port, configured to receive video data from a second display port of a former stage device;

a control circuit, coupled to the first display port, and configured to perform an anti-burn-in process on the video data according to a processing degree; and a frame buffer, configured to store the video data in a panel self-refresh mode, wherein when the control circuit receives a panel self-refresh entering command, the panel control device enters the panel self-refresh mode, and the control circuit increases the processing degree and performs the anti-burn-in process on the video data according to the increased processing degree.

2. The panel control device according to claim 1, wherein the former stage device comprises a graphics processing unit (GPU).

3. The panel control device according to claim 2, wherein each of the first display port and the second display port is an eDP port.

4. The panel control device according to claim 1, wherein the former stage device is configured to judge whether the video data indicates a static image of a whole frame and generate the panel self-refresh entering command according to the judgment result.

5. The panel control device according to claim 1, wherein the former stage device is configured to judge whether the video data comprises at least one static image region within the whole frame and generate the panel self-refresh entering command according to the judgment result.

6. The panel control device according to claim 5, wherein the former stage device is configured to divide a current frame of the video data into at least one partial update region and at least one static image region, and the panel self-refresh entering command further indicates at least one partial update region different from the at least one static image region.

7. The panel control device according to claim 1, wherein in the panel self-refresh mode, data transmission between the second display port and the first display port is turned off, and the control circuit is configured to generate a plurality of frames according to the video data stored by the frame buffer in the panel self-refresh mode.

8. The panel control device according to claim 1, wherein after the former stage device issues the panel self-refresh entering command to the panel control device, the control circuit increases the processing degree to a predetermined level instead of gradually increasing the processing degree.

9. The panel control device according to claim 8, wherein the predetermined level is a maximum level.

10. The panel control device according to claim 1, wherein the processing degree comprises a brightness control degree, and the anti-burn-in process comprises a brightness control operation.

11. The panel control device according to claim 1, wherein the processing degree comprises an edge smoothing degree, and the anti-burn-in process comprises a smooth filter operation.

12. The panel control device according to claim 1, wherein the processing degree comprises a dynamic chromatic control degree, and the anti-burn-in process comprises a dynamic chromatic control operation.

13. The panel control device according to claim 1, wherein the processing degree comprises a moving distance, and the anti-burn-in process comprises an image orbit operation.

14. The panel control device according to claim 1, wherein the former stage device is further configured to issue a panel self-refresh exiting command, and after the former stage device issues the panel self-refresh exiting command to the panel control device, the panel control device is configured to exit the panel self-refresh mode, and the control circuit is configured to reduce the processing degree according to the panel self-refresh exiting command.

15. The panel control device according to claim 14, wherein after the former stage device issues the panel self-refresh exiting command to the panel control device, the control circuit calculates an image change degree of a current frame of the video data according to a previous frame, and the control circuit determines a reducing speed of reducing the processing degree according to the image change degree.

16. The panel control device according to claim 15, wherein the control circuit rapidly reduces the processing degree at a first reducing speed when the image change degree is greater than a threshold, and the control circuit gradually reduces the processing degree at a second reducing speed slower than the first reducing speed when the image change degree is less than the threshold.

17. The panel control device according to claim 6, wherein the control circuit is configured to reduce the processing degree corresponding to the at least one partial update region or set the processing degree corresponding to the at least one partial update region to be zero in the panel self-refresh mode.

18. The panel control device according to claim 6, wherein the control circuit is configured to increase the processing degree corresponding to at least one static region of a current frame of the video data.

19. The panel control device according to claim 18, wherein the processing degree corresponding to a farer sub static region among a plurality of sub static regions of the at least one static region which is farer away from the at least one partial update region is greater than the processing degree corresponding to a nearer sub static region among the sub static regions which is nearer to the at least one partial update region.

20. An operation method of a panel control device, comprising:

receiving video data from a second display port of a former stage device by a first display port of the panel control device, wherein the panel control device is configured to drive a display panel;

performing an anti-burn-in process on the video data according to a processing degree by a control circuit of the panel control device;

when the control circuit receives a panel self-refresh entering command, entering a panel self-refresh mode by the panel control device, and increasing the processing degree and performing the anti-burn-in process on the video data by the control circuit according to the increased processing degree; and storing the video data in the panel self-refresh mode by a frame buffer of the panel control device.

21. The operation method according to claim 20, wherein the former stage device comprises a graphics processing unit (GPU).

22. The operation method according to claim 21, wherein each of the first display port and the second display port is an eDP port.

23. The operation method according to the claim 20, further comprising:

judging whether the video data indicates at least one static image within a whole frame and generating the panel self-refresh entering command according to the judgment result by the former stage device.

24. The operation method according to the claim 20, further comprising:

judging whether the video data comprises at least one static image region within the whole frame and generating the panel self-refresh entering command according to the judgment result by the former stage device.

25. The operation method according to the claim 24, further comprising:

dividing a current frame of the video data into at least one partial update region and at least one static image region by the former stage device, wherein the panel self-refresh entering command further indicates at least one partial update region different from the at least one static image region.

26. The operation method according to the claim 20, further comprising:

in the panel self-refresh mode, turning off data transmission between the second display port and the first display port; and generating a plurality of frames according to the video data stored by the frame buffer in the panel self-refresh mode by the control circuit.

27. The operation method according to the claim 20, further comprising:

after the former stage device issues the panel self-refresh entering command to the panel control device, increasing the processing degree to a predetermined level instead of gradually increasing the processing degree by the control circuit.

28. The operation method according to claim 27, wherein the predetermined level is a maximum level.

29. The operation method according to claim 20, wherein the processing degree comprises a brightness control degree, and the anti-burn-in process comprises a brightness control operation.

30. The operation method according to claim 20, wherein the processing degree comprises an edge smoothing degree, and the anti-burn-in process comprises a smooth filter operation.

31. The operation method according to claim 20, wherein the processing degree comprises a dynamic chromatic control degree, and the anti-burn-in process comprises a dynamic chromatic control operation.

32. The operation method according to claim 20, wherein the processing degree comprises a moving distance, and the anti-burn-in process comprises an image orbit operation.

33. The operation method according to the claim 20, further comprising:

issuing a panel self-refresh exiting command by the former stage device; and after the former stage device issues the panel self-refresh exiting command to the panel control device, exiting the self-refresh mode by the panel control device, and increasing the processing degree according to the panel self-refresh exiting command by the control circuit.

34. The operation method according to the claim 33, further comprising:

after the former stage device issues the panel self-refresh exiting command to the panel control device, calculating an image change degree of a current frame of the video data according to a previous frame by the control circuit; and determining a reducing speed of reducing the processing degree according to the image change degree by the control circuit.

35. The operation method according to the claim 34, further comprising:

rapidly reducing the processing degree at a first reducing speed by the control circuit when the image change degree is greater than a threshold; and gradually reducing the processing degree at a second reducing speed slower than the first reducing speed by the control circuit when the image change degree is less than the threshold.

36. The operation method according to the claim 25, further comprising:

reducing the processing degree corresponding to the at least one partial update region or setting the processing degree corresponding to the at least one partial update region to be zero in the panel self-refresh mode by the control circuit.

37. The operation method according to the claim 25, further comprising:

increasing the processing degree corresponding to at least one static region of a current frame of the video data by the control circuit.

38. The operation method according to claim 37, wherein the processing degree corresponding to a farer sub static region among a plurality of sub static regions of the at least one static region which is farer away from the at least one partial update region is greater than the processing degree corresponding to a nearer sub static region among the sub static regions which is nearer to the at least one partial update region.

39. A panel control device, configured to drive a display panel, comprising:

a first display port, configured to receive video data from a second display port of a former stage device; and a control circuit, coupled to the first display port, and configured to perform an anti-burn-in process on the video data according to a processing degree, wherein after the former stage device issues a panel self-refresh exiting command to the panel control device, the panel control device exits a panel self-refresh mode, and the control circuit reduces the processing degree according to the panel self-refresh exiting command, so as to perform the anti-burn-in process on the video data according to the reduced processing degree.

40. The panel control device according to claim 39, wherein after the former stage device issues the panel self-refresh exiting command to the panel control device, the control circuit is configured to calculate an image change degree of a current frame of the video data according to a previous frame, and the control circuit determines a reducing speed of reducing the processing degree according to the image change degree.

41. The panel control device according to claim 40, wherein the control circuit rapidly reduces the processing degree at a first reducing speed when the image change degree is greater than a threshold, and the control circuit gradually reduces the processing degree at a second reducing speed slower than the first reducing speed when the image change degree is less than the threshold.

42. An operation method of a panel control device, comprising:

receiving video data from a second display port of a former stage device by a first display port of the panel control device, wherein the panel control device is configured to drive a display panel;

performing an anti-burn-in process on the video data according to a processing degree by a control circuit of the panel control device; and after the former stage device issues a panel self-refresh exiting command to the panel control device, exiting a panel self-refresh mode by the panel control device, and reducing the processing degree according to the panel self-refresh exiting command by the control circuit, so as to perform the anti-burn-in process on the video data according to the reduced processing degree.

43. The operation method according to the claim 42, further comprising:

after the former stage device issues the panel self-refresh exiting command to the panel control device, calculating an image change degree of a current frame of the video data according to a previous frame by the control circuit; and determining a reducing speed of reducing the processing degree according to the image change degree by the control circuit.

44. The operation method according to the claim 43, further comprising:

rapidly reducing the processing degree at a first reducing speed by the control circuit when the image change degree is greater than a threshold; and gradually reducing the processing degree at a second reducing speed slower than the first reducing speed by the control circuit when the image change degree is less than the threshold.

* * * * *